US008567690B2

(12) United States Patent
De La Torre

(10) Patent No.: US 8,567,690 B2
(45) Date of Patent: Oct. 29, 2013

(54) TOY VEHICLE TRACK SET

(75) Inventor: Gabriel De La Torre, Bell Gardens, CA (US)

(73) Assignee: Mattel, Inc., El Segundo, CA (US)

( * ) Notice: Subject to any disclaimer, the term of this patent is extended or adjusted under 35 U.S.C. 154(b) by 182 days.

(21) Appl. No.: 13/220,074

(22) Filed: Aug. 29, 2011

(65) Prior Publication Data

US 2012/0322342 A1 Dec. 20, 2012

Related U.S. Application Data

(60) Provisional application No. 61/377,771, filed on Aug. 27, 2010.

(51) Int. Cl.
*E01B 23/00* (2006.01)

(52) U.S. Cl.
USPC ..... 238/10 E; 446/444

(58) Field of Classification Search
USPC ..... 104/53–56, 60, 63, 69; 446/168, 444
See application file for complete search history.

(56) References Cited

U.S. PATENT DOCUMENTS

| | | | |
|---|---|---|---|
| 985,880 | A | 3/1911 | Badisco |
| 1,367,417 | A | 2/1921 | Moore |
| 1,551,002 | A | 8/1925 | Beck |
| 2,161,314 | A | 6/1939 | Randall et al. |
| 2,853,301 | A | 9/1958 | Glass |
| 3,359,920 | A | 3/1965 | Iammatteo |
| 3,315,632 | A | 10/1965 | Hyden |
| 3,376,844 | A | 1/1966 | Wood |
| 3,502,332 | A | 3/1970 | Wolf |
| 3,600,849 | A | 8/1971 | Faller |
| 3,633,308 | A | 1/1972 | Yang |
| 3,665,636 | A | 5/1972 | Benson et al. |
| 3,720,412 | A | 3/1973 | Ramirez |
| 3,860,238 | A | 1/1975 | Kojima |
| 3,986,717 | A | 10/1976 | Kirby et al. |
| 4,077,628 | A | 3/1978 | Hebert |
| 4,108,437 | A | 8/1978 | DeAnda et al. |
| 4,128,964 | A | 12/1978 | Ogasawara |
| 4,185,409 | A | 1/1980 | Cheng |

(Continued)

FOREIGN PATENT DOCUMENTS

| | | |
|---|---|---|
| DE | 003106081 | 8/1982 |
| EP | 1184063 | 3/2002 |

(Continued)

OTHER PUBLICATIONS

International Search Report mailed mailed Apr. 27, 2012 for International Application Serial No. PCT/US2011/049519; International filing date Aug. 29, 2011.

(Continued)

*Primary Examiner* — Jason C Smith
(74) *Attorney, Agent, or Firm* — Cantor Colburn LLP

(57) ABSTRACT

In one exemplary embodiment, a toy track set for at least one toy vehicle is provided, the toy track set having: a track path; and a surface rotatably mounted to a base, wherein a portion of the surface comprises a portion of the track path and wherein as the surface rotates and spins on the base to transfer the toy vehicle from a first portion of the track to a second portion of the track.

27 Claims, 10 Drawing Sheets

(56) References Cited

U.S. PATENT DOCUMENTS

| | | | | |
|---|---|---|---|---|
| 4,254,576 | A | 3/1981 | Matsumoto et al. | |
| 4,312,149 | A | 1/1982 | Iwao | |
| 4,355,807 | A | 10/1982 | Prehodka | |
| 4,373,293 | A | 2/1983 | Kakizaki et al. | |
| 4,383,688 | A | 5/1983 | Prehodka | |
| 4,423,871 | A | 1/1984 | Mucaro | |
| 4,513,966 | A * | 4/1985 | Mucaro et al. | 238/10 F |
| 4,605,229 | A | 8/1986 | McKay | |
| 4,708,685 | A | 11/1987 | Udagawa | |
| 4,715,602 | A | 12/1987 | May et al. | |
| 4,961,716 | A | 10/1990 | Hippely et al. | |
| 5,038,685 | A | 8/1991 | Yoneda et al. | |
| 5,174,569 | A | 12/1992 | Ngai | |
| 5,542,668 | A | 8/1996 | Casale et al. | |
| 5,651,736 | A | 7/1997 | Myers | |
| 5,855,501 | A | 1/1999 | Kato et al. | |
| 6,074,269 | A | 6/2000 | Rothbarth et al. | |
| 6,478,654 | B1 | 11/2002 | Rehkemper et al. | |
| 6,517,007 | B2 | 2/2003 | Kong | |
| 6,676,480 | B2 * | 1/2004 | Sheltman | 446/429 |
| 7,241,223 | B1 | 7/2007 | Caudill | |
| 7,285,035 | B1 | 10/2007 | Tullis | |
| 7,549,906 | B2 * | 6/2009 | Bedford et al. | 446/444 |
| 7,601,068 | B1 | 10/2009 | McGee | |
| 7,628,674 | B2 * | 12/2009 | Nuttall et al. | 446/444 |
| 7,637,796 | B2 | 12/2009 | Hippely | |
| 7,651,398 | B2 | 1/2010 | Ostendorff et al. | |
| 7,690,964 | B2 | 4/2010 | Nuttall et al. | |
| 7,901,266 | B2 * | 3/2011 | Ostendorff | 446/429 |
| 2003/0224697 | A1 * | 12/2003 | Sheltman et al. | 446/444 |
| 2005/0287915 | A1 * | 12/2005 | Sheltman et al. | 446/444 |
| 2005/0287916 | A1 * | 12/2005 | Sheltman et al. | 446/444 |
| 2005/0287919 | A1 * | 12/2005 | Sheltman et al. | 446/444 |
| 2006/0286897 | A1 * | 12/2006 | Bedford et al. | 446/444 |
| 2008/0020675 | A1 * | 1/2008 | Ostendorff | 446/429 |
| 2008/0265048 | A1 * | 10/2008 | O'Connor | 238/10 E |
| 2009/0072481 | A1 * | 3/2009 | Ostendorff | 273/246 |
| 2010/0075573 | A1 | 3/2010 | Dubois | |
| 2011/0101120 | A1 * | 5/2011 | O'Connor et al. | 238/10 A |
| 2012/0322342 | A1 * | 12/2012 | De La Torre | 446/444 |

FOREIGN PATENT DOCUMENTS

| | | |
|---|---|---|
| GB | 2063084 | 6/1981 |
| GB | 2200297 | 8/1988 |
| JP | 10179943 | 7/1988 |
| WO | 9949948 | 10/1999 |

OTHER PUBLICATIONS

Written Opinion of the International Searching Authority mailed Apr. 27, 2012 for International Application Serial No. PCT/US2011/049519; International filing date Aug. 29, 2011.

* cited by examiner

TOY VEHICLE TRACK SET

CROSS REFERENCE TO RELATED APPLICATIONS

The present application claims priority to U.S. Provisional Application Ser. No. 61/377,771 filed on Aug. 27, 2010 entitled "Toy Vehicle Track Set" which is incorporated in its entirety herein.

BACKGROUND

Play sets for toy vehicles are popular toys that are known to provide entertainment and excitement to a user. These play sets typically include a track configuration intended to guide a propelled toy vehicle, such as a 1/64 scale die-cast metal toy vehicle, through a course. The track configurations include closed-loop continuous track arrangements and open-end arrangements. Toy vehicles are placed on this play set tracks and propelled across the configuration by hand or by an external propulsion means.

To bring increased entertainment and excitement to play sets, track configurations may include features such as intersecting tracks, loop segments, and other types of track configurations known in the art.

Accordingly, a play set for toy vehicles is desired which can provide the entertainment and excitement of a toy vehicle launched from a track and which also includes provisions for variations in the outcome of the vehicle travelling along the track.

BRIEF SUMMARY OF INVENTION

In one exemplary embodiment, a toy track set for at least one toy vehicle is provided, the toy track set having: a first track path having a first portion and a second portion; a second track path having a third portion and a fourth portion; a first platform movably and rotatably disposed between the first portion and the second portion; a second platform movably and rotatably disposed between the third portion and the fourth portion; and wherein the first platform is arranged to transfer a first toy vehicle from the first portion to the second portion.

In another exemplary embodiment a method of providing obstacles on a track path of a toy track set is provided, the method including the steps of: providing a first track path having a first portion and a second portion; disposing a first platform between the first portion and a second portion; receiving a first toy vehicle from the first portion on the first platform; rotating the first toy vehicle at least 360 degrees; and, transferring the first toy vehicle to the second portion.

In still another exemplary embodiment, a toy track set for a toy vehicle is provided, the toy track set having: a first track path; a second track path adjacent the first track path; a third track path coupled to receive a toy vehicle from the first track path and the second track path; a first lever arm arranged with at least a portion of the first lever arm being disposed in the third track path; a second lever arm operably coupled to the first lever arm and movable between a first position and a second position, wherein at least a portion of the second lever arm is disposed in the third track path when in the second position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
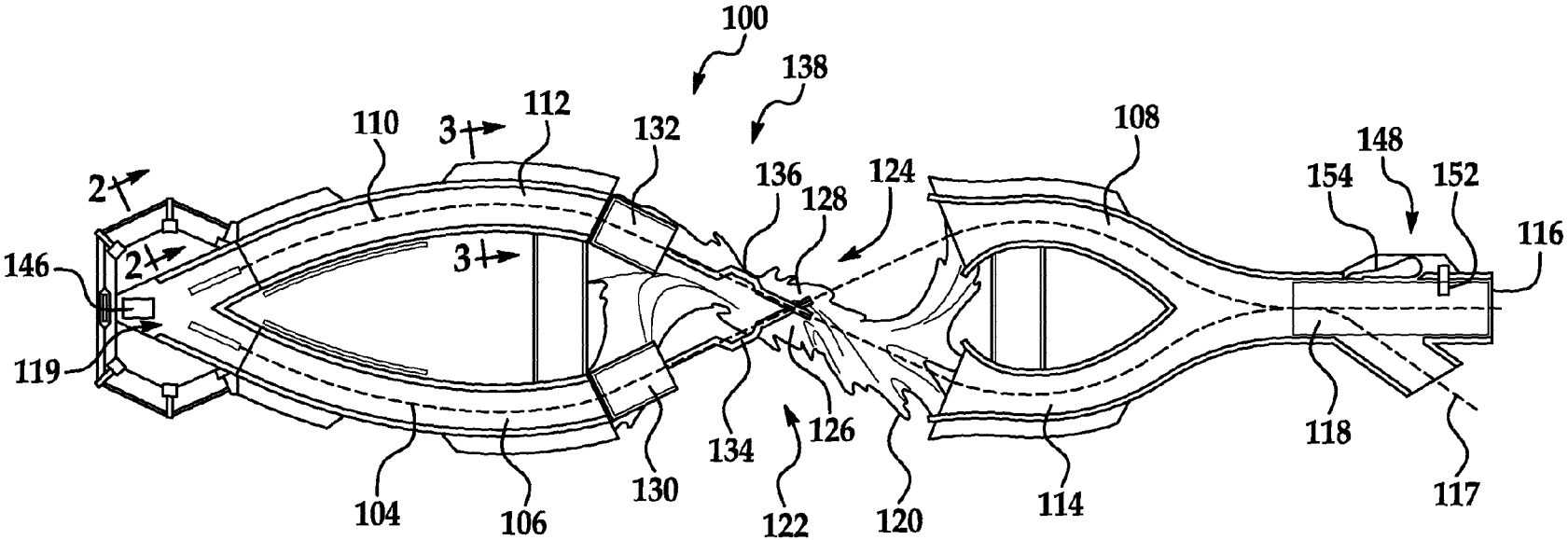
FIG. 1 is top plan view of a track set in accordance with an exemplary embodiment of the present invention.
Figure 2:
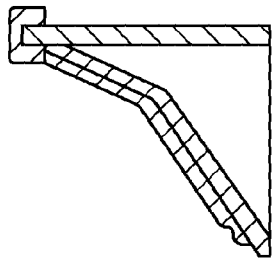
FIG. 2 is a cross sectional view of the track set of FIG. 1 along line A-A.

Referring now to the attached FIGS., the contents of which are incorporated herein by reference thereto FIGS. 1-8 illustrates one exemplary embodiment of a toy track set 100 for toy vehicles 102. In one embodiment, the toy vehicles ride on wheels disposed in contact with the tracks or portions of the toy track set. In this embodiment, the toy track set includes a first track path 104 having a first surface portion 106 and a second surface portion 108. The toy track set 100 further includes a second track path 110 having a third surface portion 112 and a fourth surface portion 114. The first track path 104 and the second track path 110 combine at an end 116 defined by surface 118 that is distal from the launch area 119. End portion 116 further includes a third track path 117 that diverges from track paths 104, 110.

The toy track set 100 further includes a base 120 that supports a first platform 122 and a second platform 124. Each platform includes a triggering mechanism 126, 128, a support surface 130, 132 and an arm 134, 136. As will be discussed in more detail below, the triggering mechanisms 126, 128 rotate the arms 134, 136 and support surfaces 130, 132 at least 360 degrees about a longitudinal axis of the respective arm as the toy vehicle is transferred across a gap 138. The trigger mechanisms 126, 128 may be any suitable mechanism having sufficient stored energy, such as by springs, elastic bands or any other suitable biasing mechanism such that a toy vehicle 102 moving on to support surface 130, 132 actuates the respective trigger mechanism to release its stored potential energy and rotate the arms 134, 136 as described herein.

In one non-limiting embodiment, the trigger mechanisms 126, 128 are arranged between the arms 134, 136 and the support surface 130, 132. The trigger mechanisms 126, 128 are actuated by the rotation arms 134, 136 that releases the stored energy to spin the support surfaces 130, 132 about the arms 134, 136. In this embodiment, the end of the arms 134, 136 is coupled by a pivot block 131 on base 120 (FIG. 7B) to allow the arms 134, 136 to rotate and transfer the toy vehicles 102.

Figure 7A:
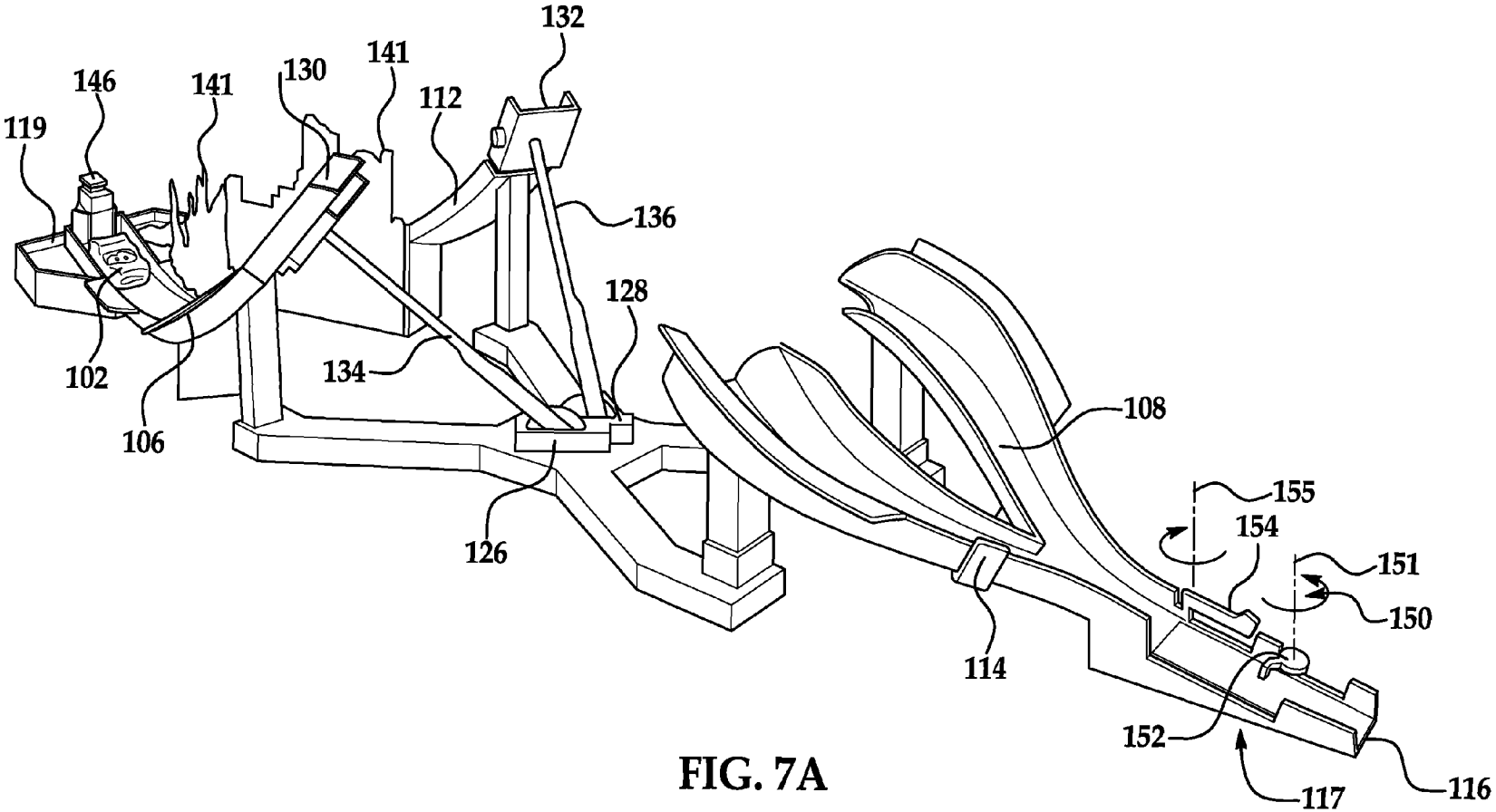
Figure 7B:
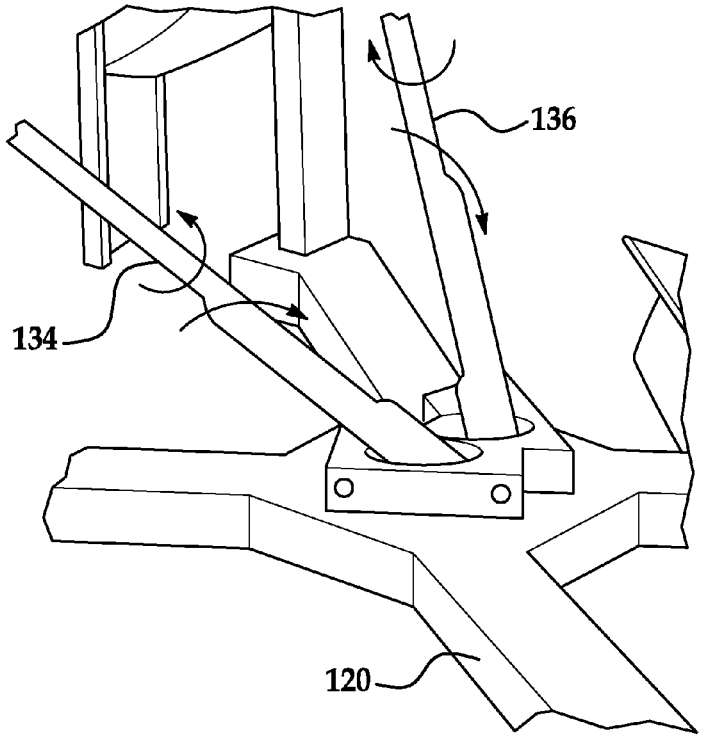
Figure 8:
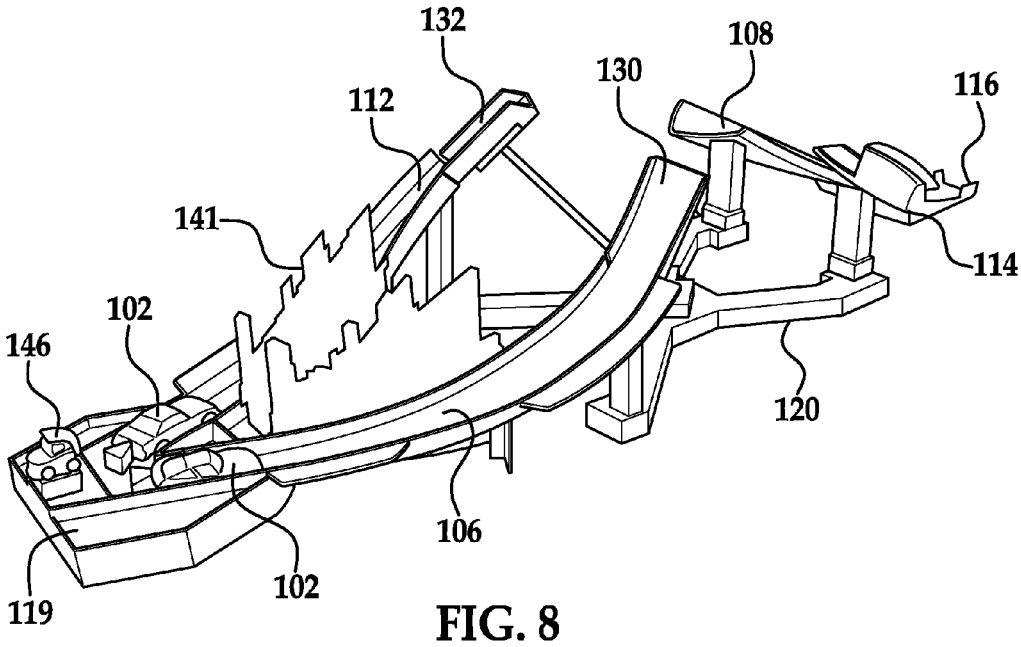
Figure 9:
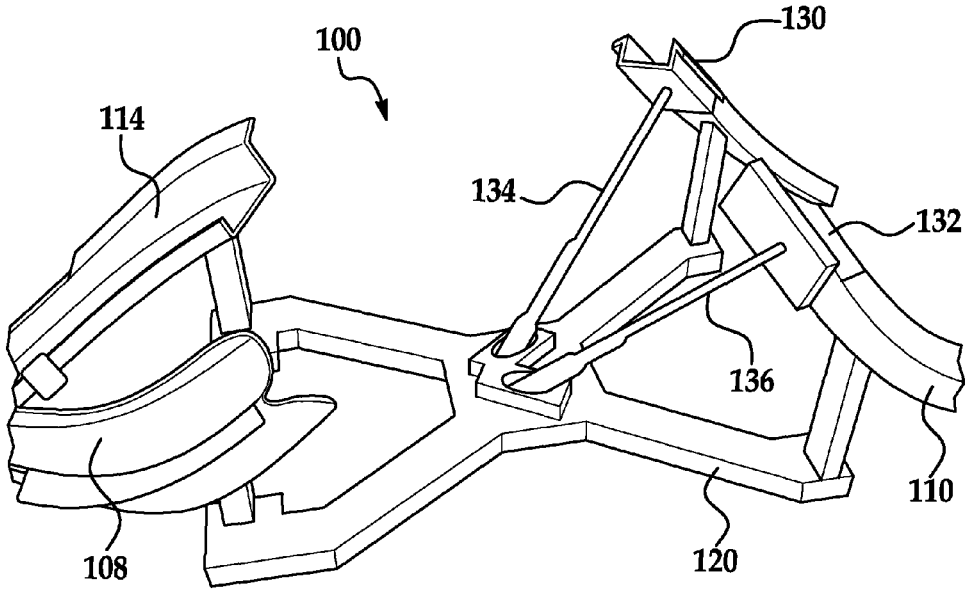
FIG. 9-17 are partial perspective views of the track set of FIG. 1 in different stages of use.

In yet another non-limiting embodiment, the trigger mechanism 126, 128 is a gearing arrangement in pivot block 131 (FIG. 7B). In this embodiment, the momentum of the toy vehicles 102 causes the rotation of the arms 134, 136. As arms 134, 136 rotate, gearing features, such as a rack and pinion arrangement for example, in the pivot block 131 uses the energy of the moving platforms to spin the arms 134, 136.

In the exemplary embodiment, the first support surface 106 and the third support surface 110 curves or ramps away from the surface upon which the toy track set 100 is arranged (hereinafter referred to as the "playing surface"). In one non-limiting embodiment, the surface portions 106, 112 also curve as shown in FIG. 1 and twist or corkscrew along their length. As the surface portions 106, 112 move away from the playing surface, a space is provided for an underpass area 140 that may be arranged in a support member 142. A user may use the underpass area 140 for storage of toy vehicles for example. As the toy vehicles are transferred across the gap 138, the track paths 104, 110 reach a zenith proximal to the center of the gap 138. The second surface portion 108 and fourth surface portion 114 ramps towards the playing surface to allow the toy vehicles to move into the distal end 116. The portions 108, 114 may also include a support member 142 having an underpass area 140.

The launcher area 119 is sized to fit at least two toy vehicles 102. In one non-limiting embodiment, the toy track set will further include a launcher 146 for launching a toy vehicle 102 along the track path. As such, the launchers may be configured to engage and urge a toy vehicle to travel along the track. It should be appreciated that although launchers are described herein, vehicles may be manually propelled along the track without the use of a launcher without departing from the scope of the disclosure.

Although any suitable launcher may be used, in the illustrated embodiments, various automatically and manually triggered release launcher elements are illustrated. A vehicle may be positioned in launch position such that a launch element may slidingly engage the vehicle to propel the vehicle along the track. The launch element may be biased to a launch position, such as by springs, elastic bands or any other suitable biasing mechanism such that release of an activator releases its stored potential energy. For example, non-limiting examples of releasable spring biased or other types of toy launchers are found in U.S. Pat. Nos. 4,108,437 and 6,435,929 and U.S. Patent Publication 2007/0293122, the contents of which are incorporated herein by reference thereto as well as launchers known to those skilled in the related arts.

Figure 3:
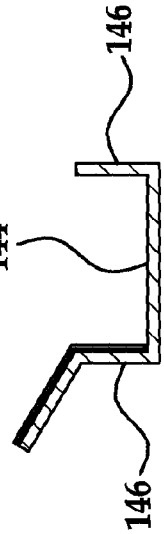
FIG. 3 is a cross sectional view of the track set of FIG. 1 along line B-B.

The track portions 104, 108, 110, 114 each include a track surface 144 that the toy vehicles traverse across and a pair of sidewalls 146 that maintain the toy vehicles on the track paths 104, 110 during use as shown in FIG. 3. Similarly, the support surfaces 130, 132 may each include a pair of sidewalls to assist in maintaining the vehicles 102 on the support surfaces 130, 132 as the toy vehicles are transferred across the gap 138.

Arranged across the surface 118 from the third track path 117 is a diverter 148. The diverter includes a triggering mechanism 150 coupled between a first lever arm 152 and a second lever arm 154. The first lever arm 152 rotates about an axis 151 towards the end 116. The first lever arm 152 is biased away from end 116, however in the exemplary embodiment the bias does not significantly impede the passage of a toy vehicle past the first lever arm 152.

The second lever arm 154 is rotatable about an axis 155 between a first position substantially aligned with the track sidewalls and a second position wherein at least a portion of the second lever arm 154 extends over the surface 118 and into the track paths 104, 110. The second lever arm 154 is biased, such as by a spring for example, to cause rotation into the second position. However, the second lever arm 154 is held or latched by the triggering mechanism 150 until the desired condition occurs. As will be discussed in more detail below, in the exemplary embodiment, the rotation of first lever arm 152 releases the triggering mechanism 150 such that when a second toy vehicle contacts and rotates the first lever arm 152 the second lever arm 154 is unlatched. The bias on the second lever arm 154 causes the rotation of the second lever arm 154 from the first position to the second position to divert the second toy vehicle into the third track path 117.

The trigger mechanism 150 may be any suitable mechanism having sufficient stored energy, such as by springs, elastic bands or any other suitable biasing mechanism such that actuation of the first lever arm 152 causes the trigger mechanism to release its stored potential energy and rotate the second lever arm 154 to divert a later following toy vehicle 102.

Figure 4:
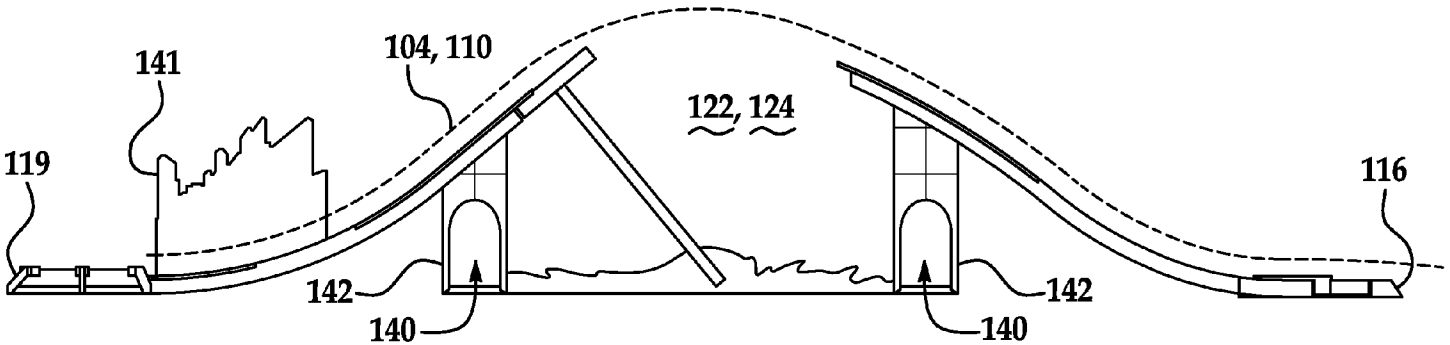
FIG. 4 is a side plan view of the track set of FIG. 1.
Figure 5:
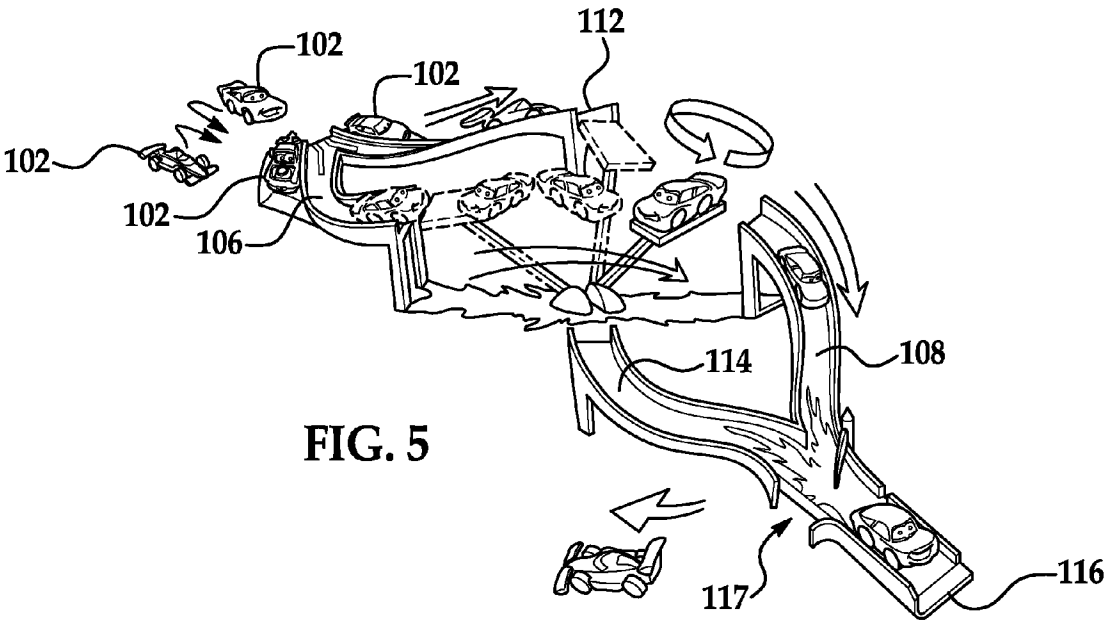
FIG. 5-8 are perspective views of the track set of FIG. 1.
Figure 6:
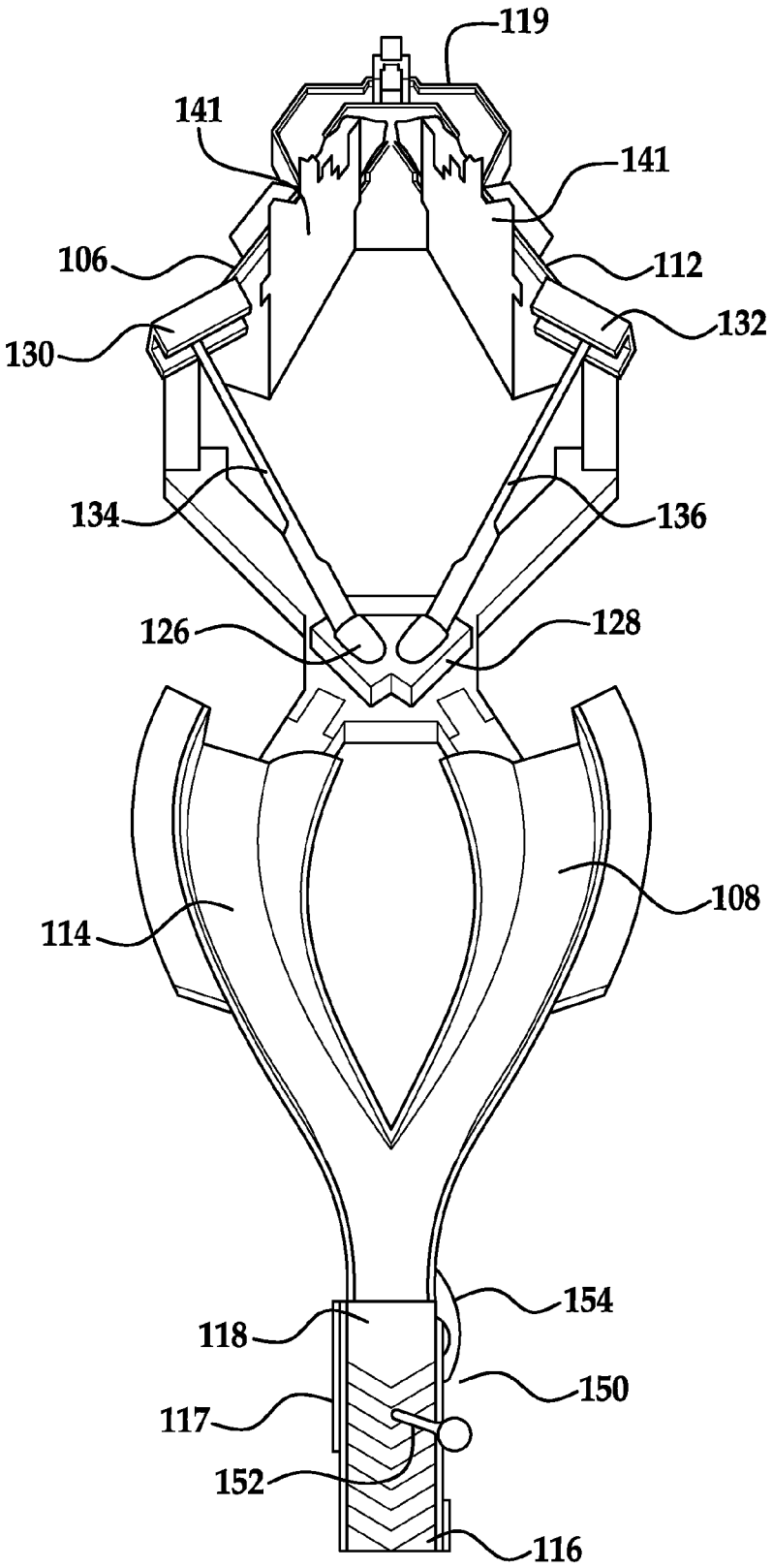

In another non-limiting embodiment, the toy track set 100 may include decorative members 141 depicting different scenes, such as a cityscape for example. The member 141 may be arranged between the first portion 106 and the third portion 112 as shown in FIG. 4. In another embodiment, a plurality of members 141 are provided with on member coupled to an inner wall of first portion 106, and another member coupled to an inner wall of third portion 112 as illustrated in FIG. 6, FIG. 8, and FIG. 10-12.

Referring now to FIG. 9-17, a non-limiting embodiment of illustrating how the toy track set 100 operates is shown. In the initial state, the toy vehicles 102 are arranged in the launcher area 146 with the launcher mechanism having sufficient stored energy to move or propel the toy vehicles 102. In the initial state, the platforms 122, 124 are in a first position (FIG. 9) where the support surfaces 130, 132 adjacent and form a substantially contiguous track surface with the track portions 106, 110. Similarly, the diverter 148 is in an initial position with the second lever arm 154 substantially aligned with the track sidewalls.

When the toy vehicles 102 are launched, either manually or by actuating the launcher mechanism, they travel along the track paths 104, 110. At the end of the first portion 106 and second portion 112, the toy vehicles 102 move onto the support surfaces 130, 132 or the platforms 122, 124 respectively. The momentum of the toy vehicles 102 is transferred into the platforms 122, 124 causing the surfaces 130, 132 to rotate about a first degree of freedom, such as axis' 156, 158 in the direction indicated by arrows 160, 162 (FIG. 10) respectively. It should be appreciated that since the axis 156, 158 are on an angle, the platforms 122, 124 will cross paths thus providing a degree of unpredictability in the users play as there may be occasions when the positions and speeds of the toy vehicles 102 will be substantially the same resulting in a collision where the platforms 122, 124 interfere with each other.

Figure 10:
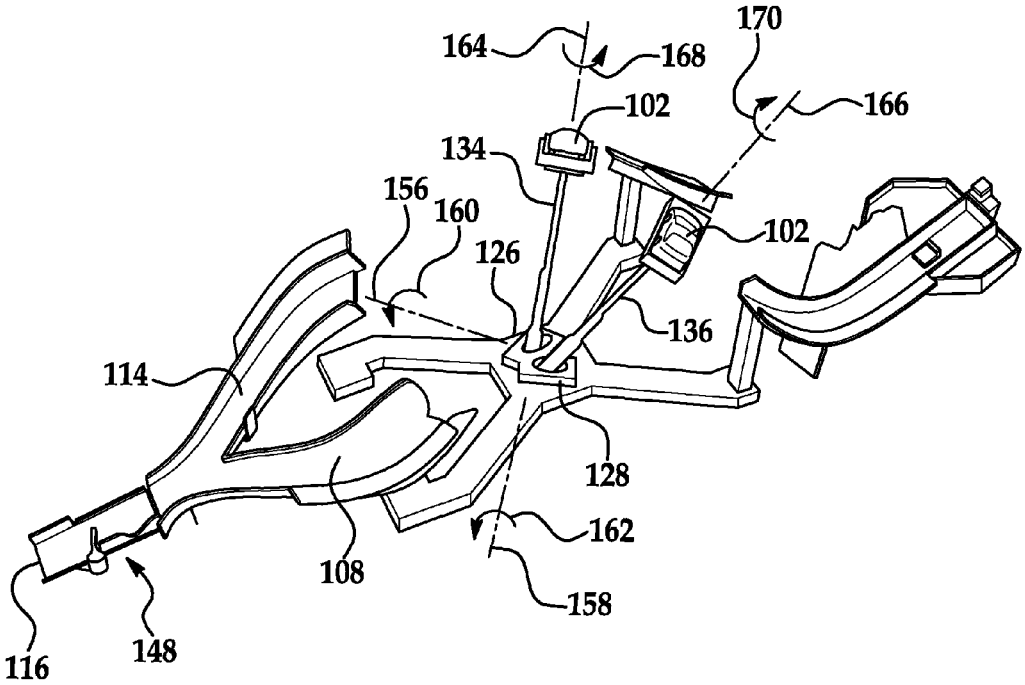
Figure 11:
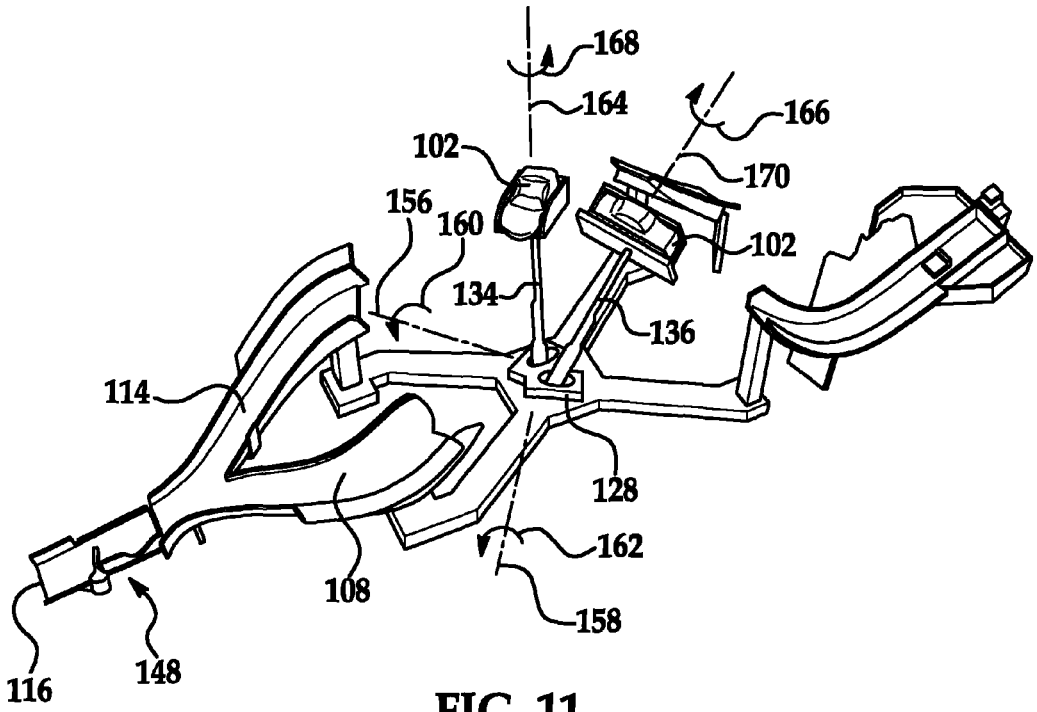
Figure 12:
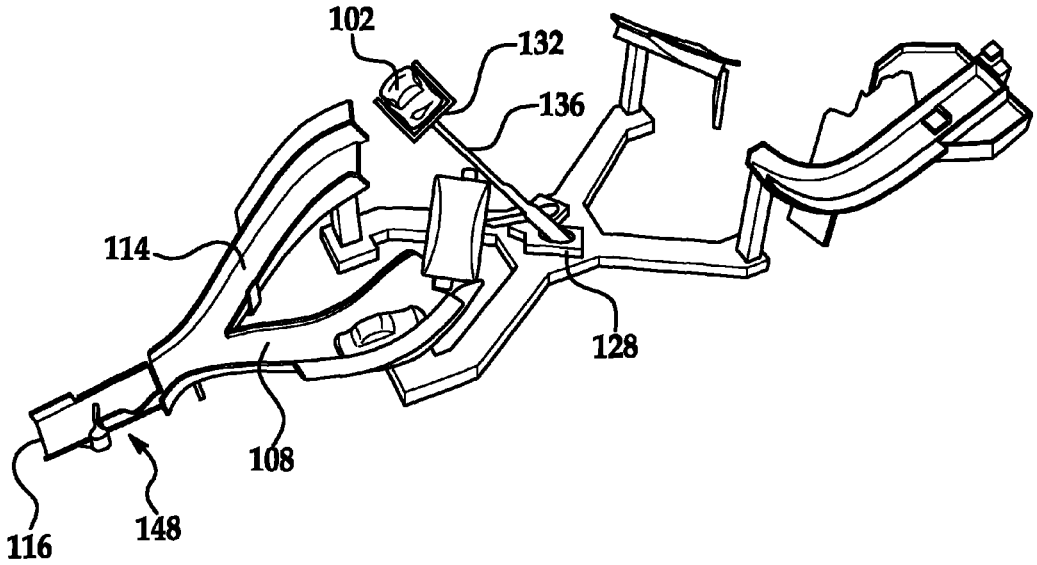

The rotation of the surfaces 130, 132 actuates the trigger mechanisms 126, 128 respectively. The trigger mechanisms 126, 128 rotate the arms 134, 136 causing the surfaces 130, 132 to rotate about a second degree of freedom, such as axis 164, 166 that extend through the length of the arms 134, 136 as shown in FIGS. 10-11. The second degree of freedom is substantially perpendicular to the first degree of freedom. In one non-limiting embodiment, the trigger mechanisms 126, 128 rotates the arms 134, 136 in opposite directions, such as the arm 134 is rotated counter clockwise as indicated by arrow 168 and arm 136 is rotated clockwise as indicated by arrow 170. In another non-limiting embodiment an object, such as a vehicle or other toy, is launched from the platform surfaces when the arm is rotated. In yet another non-limiting embodiment, the slower second toy vehicle 102 is launched off of the tracks as the arm is rotated.

Figure 13:
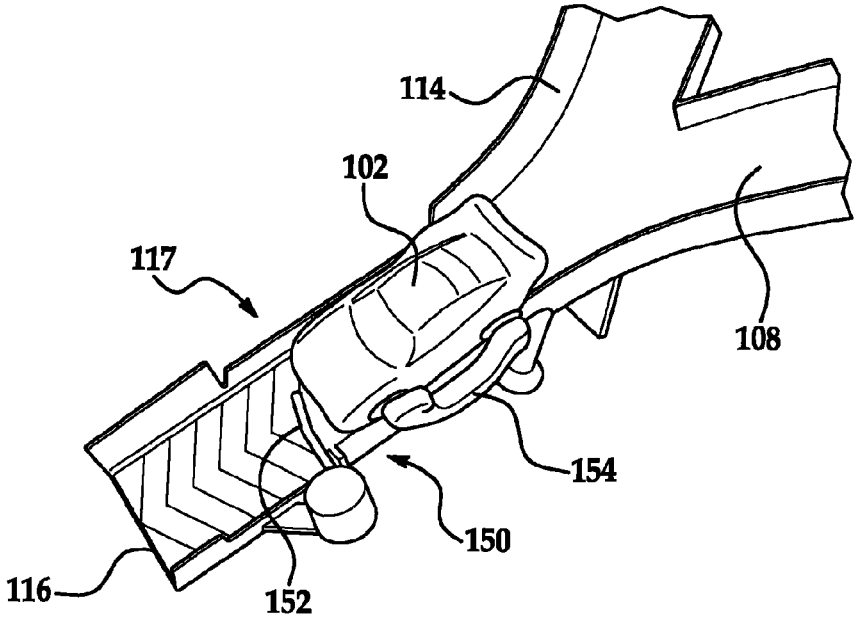

Typically, one of the toy vehicles 102 will be slightly faster than the other allowing the vehicles to transfer across the gap 138 without interference. This allows the faster toy vehicle 102 to be transferred across the gap 138 first. In the embodiment shown in FIG. 12, the toy vehicle on the first track path 104 arrives at the portion 108 while the other toy vehicle is still on platform 124. Thus the toy vehicle 102 on portion 108 proceeds towards distal end 116 before the other toy vehicle 102. As the first toy vehicle 102 approaches the distal end 116, it contacts first lever arm 152 that is extending over surface 118 as shown in FIG. 13.

Figure 14:
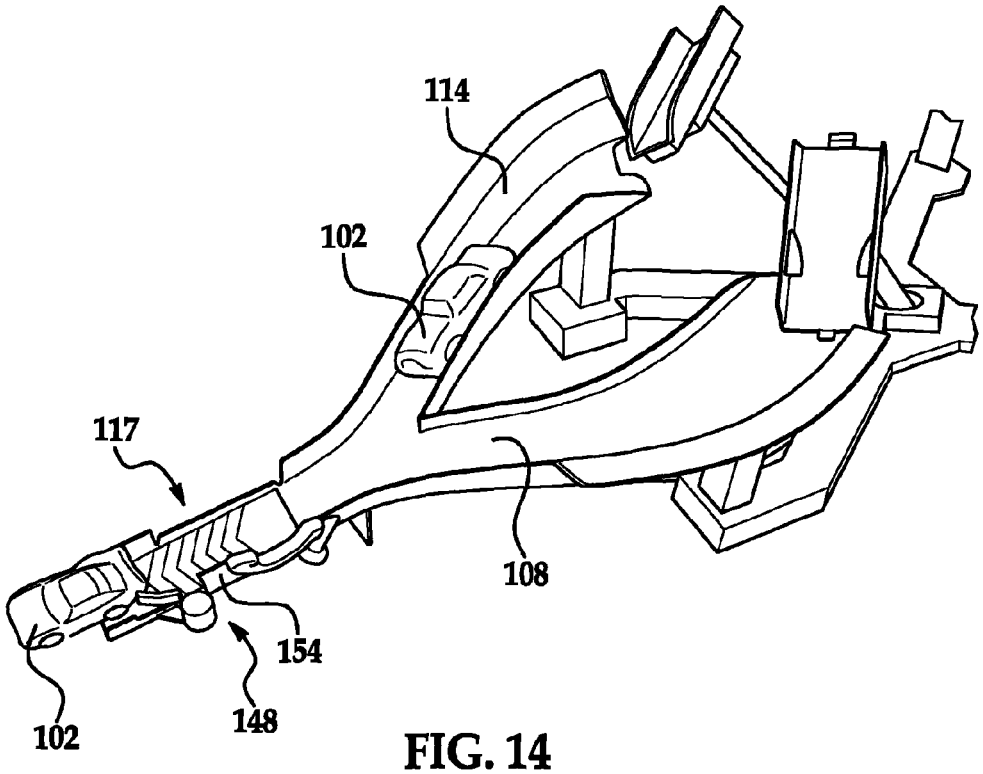
Figure 15:
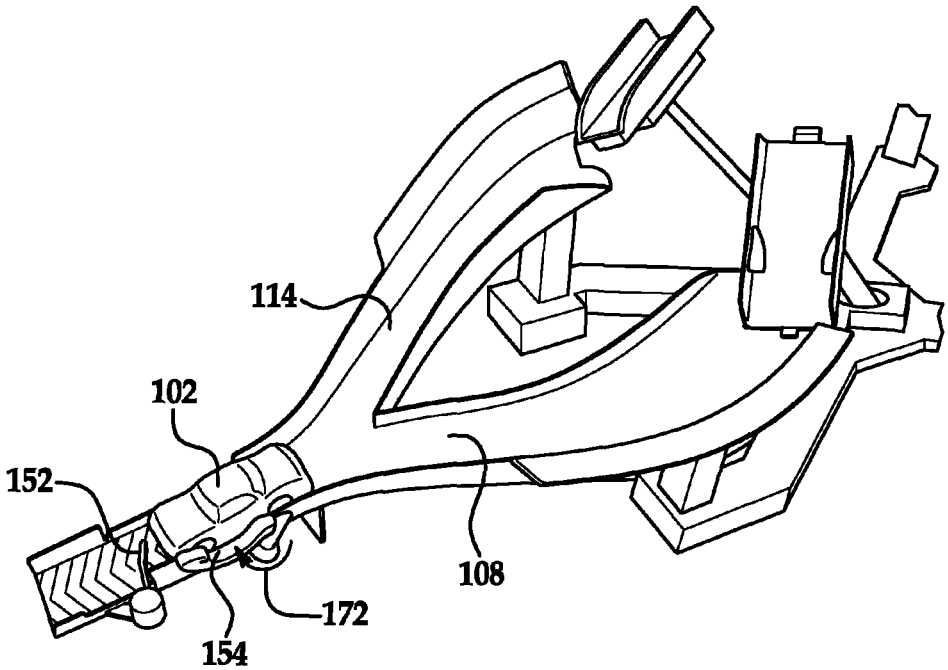
Figure 16:
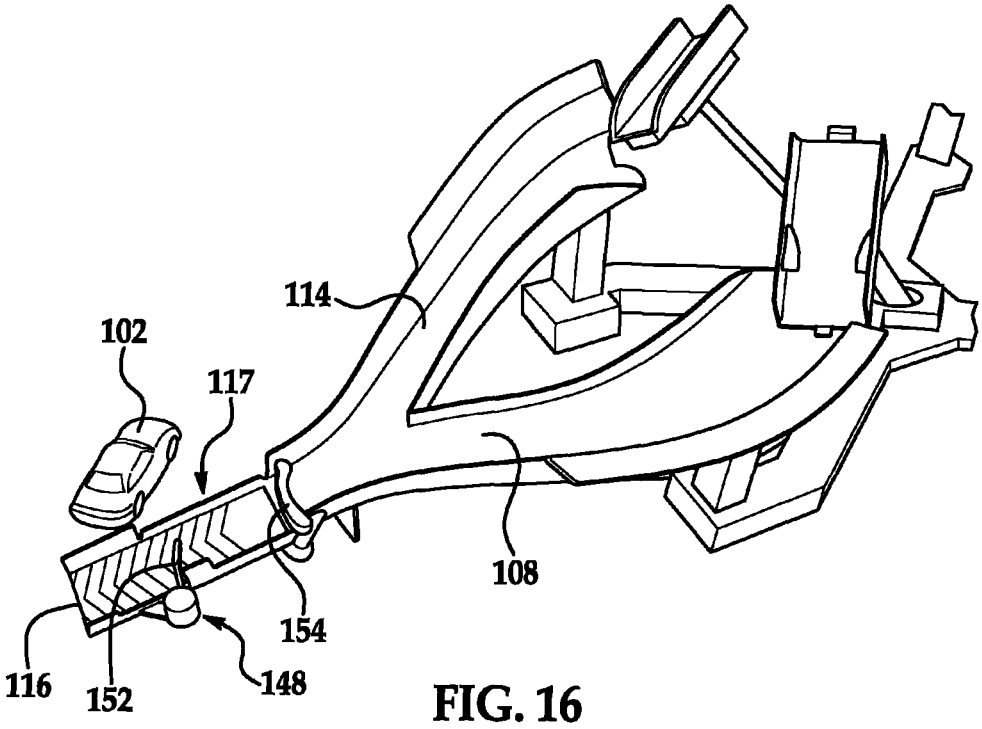
Figure 17:
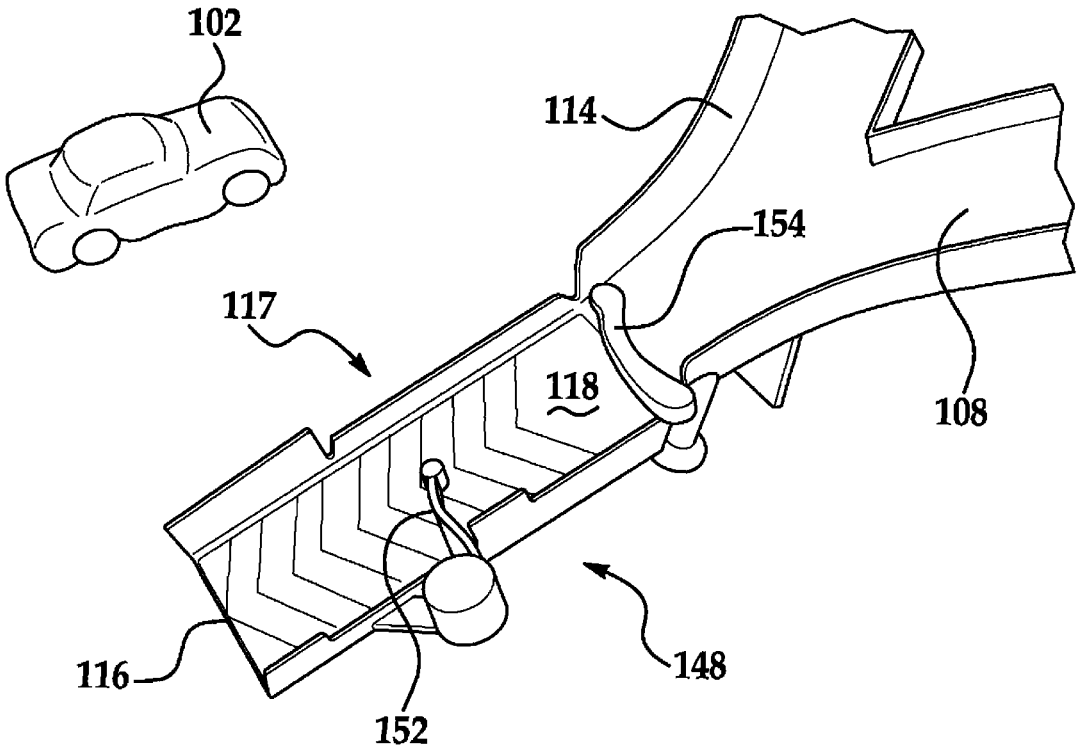

The contact of the first toy vehicle 102 causes the rotation of the first lever arm 152 and thus actuating trigger mechanism 150. The first toy vehicle 102 proceeds to exit the track path 104 via end 116 as shown in FIG. 14 while the second toy vehicle 102 proceeds along portion 114. When the second toy vehicle 102 contacts the first lever arm 152 (FIG. 15), the second lever arm 154 is released or unlatched, which allows the second arm to rotate under the biasing force into the track path 104, 110 as indicated by arrow 172. The rotation of the second lever arm 154 causes second lever arm 154 to contact the second toy vehicle 102 diverting it onto the third track path 117 as shown in FIGS. 16-17. In one non-limiting embodiment, the second lever arm 154 contacts the rear portion of the second toy vehicle 102 causing the second toy vehicle 102 to spin as the toy vehicle is diverted to simulate a "spinout" condition.

Accordingly and as discussed above, enhanced play is provided to the track set wherein the user enjoys a degree of unpredictability in the racing of toy vehicles. In other words, a user may have numerous options of play wherein in one race the vehicles may collide as while spinning and rotating during the transfer across the gap or when entering the final segment of the race. Further, the user gets to enjoy seeing the second place finisher be spun out.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

The invention claimed is:

1. A toy track set for at least one toy vehicle, comprising:
a first track path having a first portion and a second portion;
a second track path having a third portion and a fourth portion;
a first platform movably and rotatably disposed between the first portion and the second portion, wherein the first platform is configured to rotate about a first axis and a second axis;
a second platform movably and rotatably disposed between the third portion and the fourth portion, wherein the second platform is configured to rotate about a third axis and a fourth axis; and,
wherein the first platform is arranged to rotate about the first axis and second axis to transfer a first toy vehicle from the first portion to the second portion.

2. The toy track set as in claim 1, wherein the second platform is arranged to transfer a second toy vehicle from the third portion to the fourth portion.

3. The toy track set as in claim 2, wherein the first platform includes:
a first triggering mechanism operably coupled to a base;
a first arm rotationally coupled to the first triggering mechanism; and,
a first support surface disposed on an end of the first arm.

4. The toy track set as in claim 2, wherein the first track path and the second track path intersect adjacent the first portion and the third portion, and the second portion and the fourth portion intersect to form a fifth portion.

5. The toy track set as in claim 4, further comprising:
a first lever arm disposed in communication with the fifth portion;
a second lever arm movable between a first position external to the fifth portion and a second position wherein at least a portion of the second lever arm is disposed in the fifth portion; and,
a third triggering mechanism operably coupled to the first lever arm and the second lever arm wherein the third triggering mechanism is arranged to contact the second lever arm into the second toy vehicle when the first toy vehicle contacts the first lever arm.

6. The toy track set as in claim 5, wherein the fifth portion includes a first opening adjacent the first lever arm and a second opening adjacent the second lever arm, wherein the second toy vehicle moves through the second opening when the second lever arm contacts the second toy vehicle.

7. A toy track set for at least one toy vehicle, comprising:
a first track path having a first portion and a second portion;
a second track path having a third portion and a fourth portion;
a first platform movably and rotatably disposed between the first portion and the second portion, wherein the first platform is arranged to transfer a first toy vehicle from the first portion to the second portion;
a second platform movably and rotatably disposed between the third portion and the fourth portion;
wherein the second platform is arranged to transfer a second toy vehicle from the third portion to the fourth portion;
wherein the first platform includes a first triggering mechanism operably coupled to a base, a first arm rotationally coupled to the first triggering mechanism, and a first support surface disposed on an end of the first arm;
wherein the first arm rotates the first support surface at least 360 degrees when transferring the first toy vehicle from the first portion to the second portion.

8. The toy track set as in claim 7, wherein the second platform includes:
a second triggering mechanism coupled to the base;
a second arm rotationally coupled to the second triggering mechanism; and,
a second support surface disposed on an end of the second arm.

9. The toy track set as in claim 8, wherein the second arm rotates the second support surface at least 360 degrees when transferring the first toy vehicle from the third portion to the fourth portion.

10. A method of operating a toy track set, comprising:
providing a first track path having a first portion and a second portion;
disposing a first platform between the first portion and the second portion;
receiving a first toy vehicle from the first portion on the first platform;
rotating the first toy vehicle at least 360 degrees; and,
transferring the first toy vehicle to the second portion.

11. The method as in claim 10 further comprising:
providing a second track path having a third portion and a fourth portion;
disposing a second platform between the third portion and the fourth portion;
receiving a second toy vehicle from the third portion on the second platform;
rotating the second toy vehicle at least 360 degrees; and,
transferring the second toy vehicle to the fourth portion.

12. The method as in claim 10 further comprising:

contacting a first lever arm with the first toy vehicle;

releasing a triggering mechanism in response to the first toy vehicle contacting the first lever arm; and, moving a second toy vehicle with a second lever arm in response to the triggering mechanism being released.

13. The method as in claim 12, further comprising:

providing a second track path, the second toy vehicle being disposed on the second track path; and, moving the second toy vehicle off the second track path in response to the second lever arm moving the second toy vehicle.

14. A toy track set for a toy vehicle, comprising:

a first track path;

a second track path adjacent the first track path;

a third track path coupled to receive the toy vehicle from the first track path and the second track path;

a first lever arm arranged with at least a portion of the first lever arm being disposed in the third track path;

a second lever arm operably coupled to the first lever arm and movable between a first position and a second position, wherein at least a portion of the second lever arm is disposed in the third track path when in the second position.

15. The toy track set as in claim 14 further comprising a triggering mechanism operably coupled between the first lever arm and the second lever arm, wherein the triggering mechanism moves the second lever arm from the first position to the second position when actuated by the first lever arm.

16. The toy track set as in claim 15 wherein the first lever arm actuates the triggering mechanism when a first toy vehicle contacts the first lever arm.

17. The toy track set as in claim 16, wherein:

the first track path includes a first portion spaced apart from a second portion by a gap;

the second track path includes a third portion spaced apart by the gap from a fourth portion;

wherein the first track path and the second track path intersect in the gap.

18. The toy track set as in claim 17, further comprising:

a first platform disposed in the gap and operably coupled to transfer the first toy vehicle from the first portion to the second portion; and, a second platform disposed in the gap and operably coupled to transfer a second toy vehicle from the third portion to the portion.

19. The toy track set as in claim 18, wherein:

the first platform includes a second trigger mechanism coupled to a base, a first surface arranged in movable communication with the first portion and the second portion, and a first arm coupled between the second trigger mechanism and the first surface;

the second platform includes a third trigger mechanism coupled to the base, a second surface arranged in movable communication with the third portion and the fourth portion, and a second arm coupled between the third trigger mechanism and the second surface.

20. The toy track set as in claim 19, wherein the second trigger mechanism rotates the first surface at least 360 degrees when transferring the first toy vehicle from the first portion to the second portion, and the third trigger mechanism rotates the second surface at least 360 degrees when transferring the second toy vehicle from the third portion to the fourth portion, wherein the second trigger mechanism is actuated by the first toy vehicle moving onto the first surface and the second trigger mechanism is actuated by the second toy vehicle moving onto the second surface.

21. A toy comprising:

a base;

a trigger mechanism coupled to the base;

an arm coupled to the trigger mechanism and configured to rotate about a first degree of freedom between a first position and a second position;

a platform coupled to the an end of the arm opposite the trigger mechanism; and, wherein the arm rotates at least 360 degrees from the first position to the second position in response to the trigger mechanism being activated.

22. The toy of claim 21 wherein the arm is further configured to rotate about a second degree of freedom as the arm rotates from the first position and the second position.

23. The toy of claim 22 wherein the second degree of freedom is about an axis substantially co-linear with a longitudinal axis of the arm.

24. The toy of claim 23 wherein the first degree of freedom is substantially perpendicular to the second degree of freedom.

25. The toy of claim 24 wherein the trigger mechanism includes a biasing device to rotate the arm from the first position to the second position.

26. The toy of claim 23 wherein the platform is configured to launch an object when the arm is rotated to the second position.

27. The toy of claim 26 wherein the trigger mechanism includes a pivot block, the pivot block having a gearing arrangement for rotating the arm about the second degree of freedom.

* * * * *